US006714170B2

(12) United States Patent
Kleinschmidt

(10) Patent No.: US 6,714,170 B2
(45) Date of Patent: Mar. 30, 2004

(54) SATELLITE DISH FOR TRUCKS

(76) Inventor: Robert Kleinschmidt, 1031 Ficklen Church Way, Canton, GA (US) 30114

( * ) Notice: Subject to any disclaimer, the term of this patent is extended or adjusted under 35 U.S.C. 154(b) by 21 days.

(21) Appl. No.: 10/229,849

(22) Filed: Aug. 28, 2002

(65) Prior Publication Data

US 2003/0107526 A1 Jun. 12, 2003

Related U.S. Application Data

(60) Provisional application No. 60/340,918, filed on Dec. 12, 2001.

(51) Int. Cl.[7] ..... H01Q 1/10; H01Q 1/32

(52) U.S. Cl. ..... 343/883; 343/882; 343/766; 343/713

(58) Field of Search ..... 343/883, 882, 343/880, 881, 878, 711, 713, 766; H01Q 1/10, 1/32

(56) References Cited

U.S. PATENT DOCUMENTS 4,062,156 A * 12/1977 Roth ..... 343/903
4,663,633 A 5/1987 Wilson
5,426,444 A * 6/1995 Sauter et al. ..... 343/883
5,945,945 A * 8/1999 Wagner et al. ..... 343/882
6,037,913 A * 3/2000 Johnson ..... 343/882
6,191,734 B1 2/2001 Park et al.

* cited by examiner

*Primary Examiner*—Hoanganh Le
(74) *Attorney, Agent, or Firm*—Bracewell & Patterson, L.L.P.

(57) ABSTRACT

A satellite dish assembly is mounted on the exterior of a vehicle. The dish assembly is in its traveling position while the vehicle is traveling from one place to another. The satellite dish is below the uppermost portion of the vehicle while in the assembly's traveling position. The satellite dish assembly raises and the aims the dish towards a transmitting satellite after the vehicle reaches its destination. One motor raises the satellite dish with a telescoping mast. Two other motors adjust the direction the dish is facing by rotating and tilting the dish on top of the mast. The satellite dish receives the signals from the transmitting satellite and communicates the signals into the vehicle. The motors are used to reposition the satellite dish in its traveling position before the vehicle starts for its next destination.

20 Claims, 5 Drawing Sheets

SATELLITE DISH FOR TRUCKS

RELATED APPLICATIONS

Applicant claims priority to the application described herein through a United States provisional patent application titled "Satellite Dish for Trucks," having U.S. patent application Ser. No. 60/340,918 which was filed on Dec. 12, 2001, and which is incorporated herein by reference in its entirety.

BACKGROUND OF THE INVENTION

1. Field of the Invention

The invention relates generally to a satellite dish assembly that may be mounted to a mobile vehicle, and can be raised and directed for reception when the vehicle is stopped, and lowered in a protective position while the vehicle is moving.

2. Description of the Related Art

The use of parabolic reflector satellite antenna systems is well known. Most such systems are established for use at a fixed location, that is, the location of the antenna does not change. Stationary systems are completely satisfactory for the satellite receiver antenna is used to supply signals such as to a residence, apartment, complex, motel, office building, etc. With such stationary systems the parabolic reflector portion of the antenna remains substantially always in a fixed operating position with provision normally being made for minor adjustments depending upon specific satellites from which signals are to be received.

A more difficult problem exists in providing problem exists in providing satellite systems for mobile use. A particular problem exists for users of eighteen-wheelers, trailer homes, motor homes, etc., wherein the vehicle frequently moves from one location to another. Many users change the position of their vehicle almost daily during travel. When a house trailer or mobile home is parked at a temporary location it is usually impossible to align the vehicle in a preselected orientation. Therefore, in order to receive signals transmitted by satellite, an antenna system must be provided which is completely flexible to orient a parabolic dish towards a desired transmitting satellite.

Attempts have been made in the in order to have a retractable satellite dish assembly mounted a vehicle. These assemblies have the dish on top of the vehicle with little protection from objects such as rocks or birds while the vehicle is traveling.

SUMMARY OF THE INVENTION

A receiver or satellite dish is mounted to a vehicle to receive transmissions from an orbiting satellite. The receiver is mounted on a rod or mast that is attached to the vehicle. Typically, the receiver is mounted to a backside portion of the vehicle. A motor located below the satellite raises and lowers the mast to elevate the receiver above the uppermost portion of the vehicle so that the receiver can receive signals from the transmitting satellite. The satellite dish and mast are lowered while the vehicle travels. The motor raises the mast and satellite when the vehicle reaches a destination and the operator wants to receive a signal in order to watch television or work on the computer.

Additional motors are located below the satellite dish to adjust the direction that the satellite dish is facing so that the satellite dish can receive the signal from the transmitting satellite. One of these motors rotates the direction the dish is facing along the horizon, and the other motor tilts the dish so that it is angled to the sky. Using both of these motors, the operator can aim the dish the satellite transmitting to the area where the vehicle is located.

A control box is located inside the vehicle so that the operator can aim the satellite from inside the vehicle. Aiming the satellite can be accomplished by inputting the zip code of the area or the nearest city or town. After inputting the information into the control box, the dish is automatically aimed at the satellite.

When the operator decides to change locations, the operator uses the satellite dish control box to engage the motors. The motors maneuver the satellite dish to a position that it can be lowered without damaging the dish or the vehicle. Then the elevation motor lowers the mast and the satellite dish into the traveling position.

This assembly allows an operator to easily locate and aim the satellite dish to a transmitting satellite without having to position the vehicle a certain direction. With this assembly the operator also does not have to exit the vehicle in order to aim or retract the satellite dish. Furthermore, the vehicle provides protection for the satellite from rocks or birds as the vehicle is traveling that could have damaged a satellite on protruding above the vehicle.

DETAILED DESCRIPTION OF THE PREFERRED EMBODIMENTS

Figure 1:
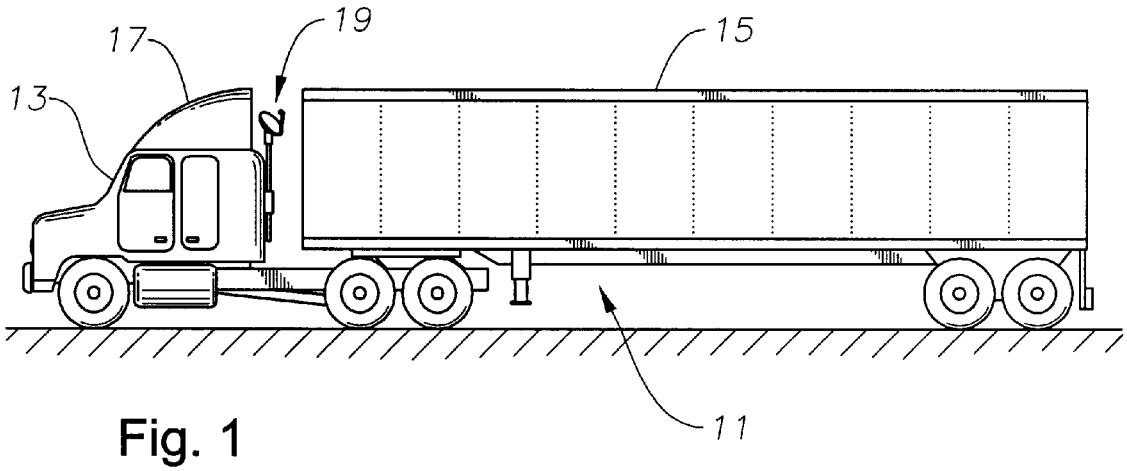
FIG. 1 is a perspective view of a tractor-trailer rig, which has a satellite dish assembly constructed in accordance with this application.

FIG. 1 shows an "eighteen-wheeler" or tractor-trailer rig 11, in which there is a tractor 13, and a trailer 15 that is towed by tractor 13. There is a wind foil 17 on top of tractor 13. Wind foil 17 substantially covers the rooftop of tractor 13 from the windshield to the backside of tractor 13, and is angled in such a way as to make an angled transitional surface for air to flow from tractor 13 to trailer 15. Wind foil 17 helps to improve the aerodynamics of tractor-trailed rig 11 as it travels down the road.

Figure 2:
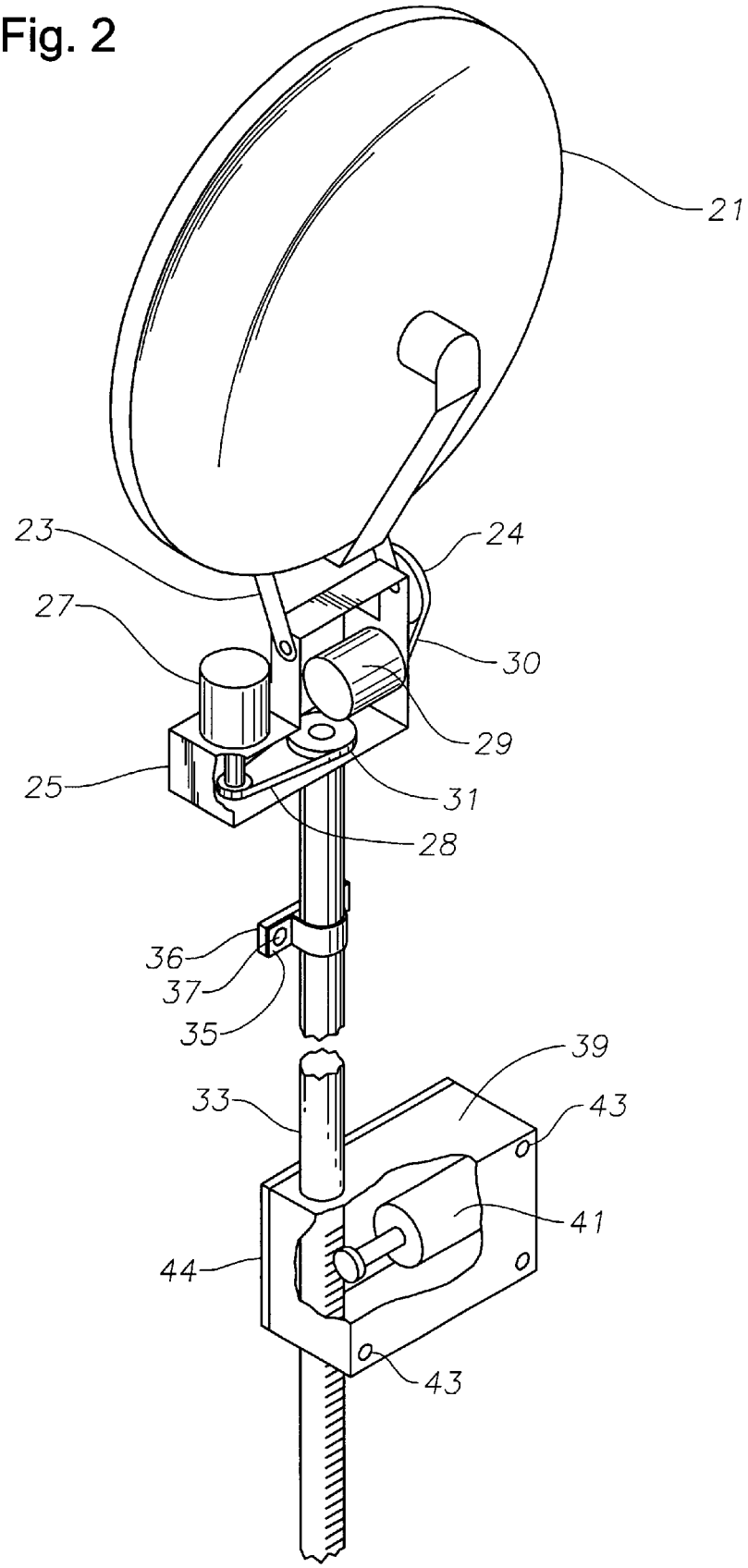
FIG. 2 is a perspective view of a satellite dish assembly constructed in accordance with this application, with portions broken away.
Figure 3:
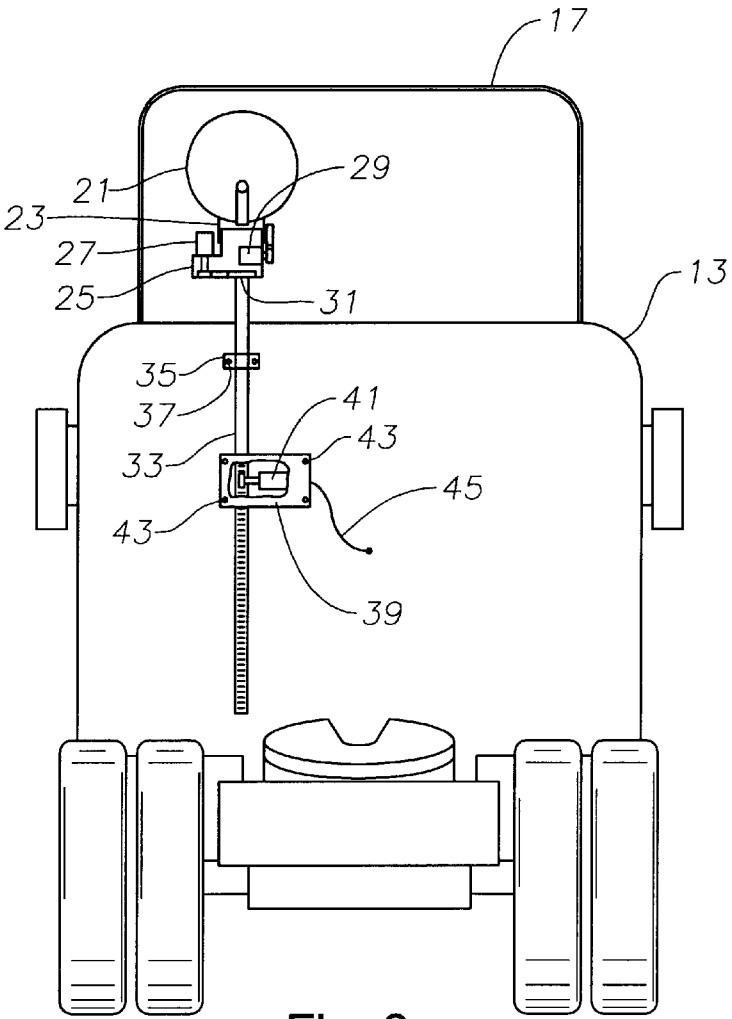
FIG. 3 is a perspective view of a tractor-trailer rig, which has the satellite dish assembly of FIG. 2, in its lowered and traveling position.

A satellite dish assembly 19 is attached to the backside of tractor 13, between tractor 13 and trailer 15 for receiving television or other transmissions from a transmitting satellite. FIG. 2 shows satellite dish assembly 19, mounted on tractor 13, when looking at the backside of tractor 13 without trailer 15 attached. Referring to FIGS. 2 and 3, there is a parabolic satellite dish or receiver 21 at the top of satellite dish assembly 19. A support member 23 (FIG. 4) is connected to the underside of dish 21 extending down to a motor assembly 25. Motor assembly 25 holds two motors, a rotational or azimuth motor 27 for rotating dish 21 about a vertical axis along the horizon, and an angular motor 29 for angling dish 21 at different angles in the sky above. A angular circular disk 24 is fixedly connected to support member 23 to translate rotations from angular motor 29 to change the angle dish 21 is pointing. Angular disk 24 is fixedly attached so that dish 21 rotates with disk 24 as disk 24 rotates about its center point. The drive member of angular motor 29 adjusts the angle of satellite dish 21 through a flexible linkage, preferably a belt 30 which engages angular disk 24 and support member 23.

Motor assembly 25 is connected on top of a bearing or rotating disk 31, which turns the entire assembly above rotating disk 31 when azimuth motor 27 is operated. The drive member of azimuth motor 27 turns motor assembly 25 on rotating disk 31 by driving a flexible linkage, preferably a rotational belt and pulley system 28. Rotating disk 31 is connected to the top of telescoping mast 33. Telescoping mast 33 is substantially cylindrical in shape and can be extended so that dish 21 is higher than the top edge of wind foil 17, as well as being higher than the top of trailer 15 (FIG. 1).

Mast 33 is held near the backside of tractor 13 by a bracket 35 located on the upper portion of the backside of tractor 13. Bracket 35 has flat surfaces on both sides of mast 33 that are parallel to the backside of tractor 13. In the preferred embodiment, a gasket 36 (shown in FIGS. 2 and 9), which can be rubber, is located between the backside of tractor 13 and bracket 35. Each flat surface of bracket 35 on both sides of mast 33 is held to the backside of tractor 13 by a fastener 37, which in the preferred embodiment is a screw. Each flat surface of bracket 35 on both sides of mast 33 is connected by a loop extending from each flat surface, and going around the outside of mast 33, away from backside of tractor 13. Bracket 35 holds mast 33 in a manner that prevents horizontal movements of mast 33 away from the backside of tractor 13, and prevents horizontal movements along the backside of tractor 13, while still allowing mast 33 to travel in the vertical direction when mast 33 is raised and lowered.

Mast 33 is also held by a motor box 39, which is also located on the backside of tractor 13. In this embodiment, motor box 39 is located below bracket 35. In this embodiment, motor box 39 is tubing having a substantially square shaped cross-section. Motor box 39 holds mast 33 within a passageway of motor box 39 that mast 33 passes through. Like bracket 35, the passageway of motor box 39 prevents horizontal movement of mast 33, while allowing mast 33 to travel vertically through the passageway of motor box 39.

An elevation motor 41 is also held inside of motor box 39, and is connected to mast 33. In the embodiment shown in FIGS. 2–5, motor 41 has a drive shaft that is perpendicular to mast 33. In the embodiment shown in FIGS. 2–5, a pinion gear 42 engages a set of teeth 44 formed on mast 33. Elevation motor 41 could also raise mast 33 through other methods known in the art that are not shown in FIGS. 2–5. For example, mast 33 could easily be adapted to be raised by a chain drive system (not shown) driven by elevation motor 41. Elevation motor 41, which in the preferred embodiment is a linear actuator, raises and lowers mast 33, which in turn raises and lowers dish 21 above and below the top edge of wind foil 17.

Motor box 39 is connected to the backside of tractor 13 by fasteners 43, which in this embodiment are screws. In the preferred embodiment a gasket 44 (shown in FIGS. 2 and 9), which can be rubber is located between tractor 13 and motor box 39. Gasket 44 may help reduce the vibrations on dish assembly 19 during travel. Control wires 45 extend from motor box 39, through an opening in the backside of tractor 13, into the passenger compartment of tractor 13 so that an operator can point dish 21 at a transmitting satellite from inside tractor 13.

In operation, while tractor-trailer rig 11 is driven, satellite dish assembly is in its lowered or traveling position. While in the lowered position, dish 21 is both behind wind foil 17 and below the top edge of wind foil 17, so dish 21 is protected against the wind that is passing by the tractor-trailer as it travels at high speeds. Dish 21 is also protected from any solid objects traveling over the tractor-trailer rig 11, like rocks or birds, because dish 21 is behind and below the top edge of wind foil 17. In its lowered or traveling position, dish 21 is pointed directly at trailer 15. When tractor-trailer rig 11 comes to a stop, the dish may be raised into its raised or stationary position. Using controls located inside the passenger compartment of tractor that are connected to motor box 39 via control wires 45, the operator can position satellite dish 21 to receive the transmission from the satellite.

Figure 4:
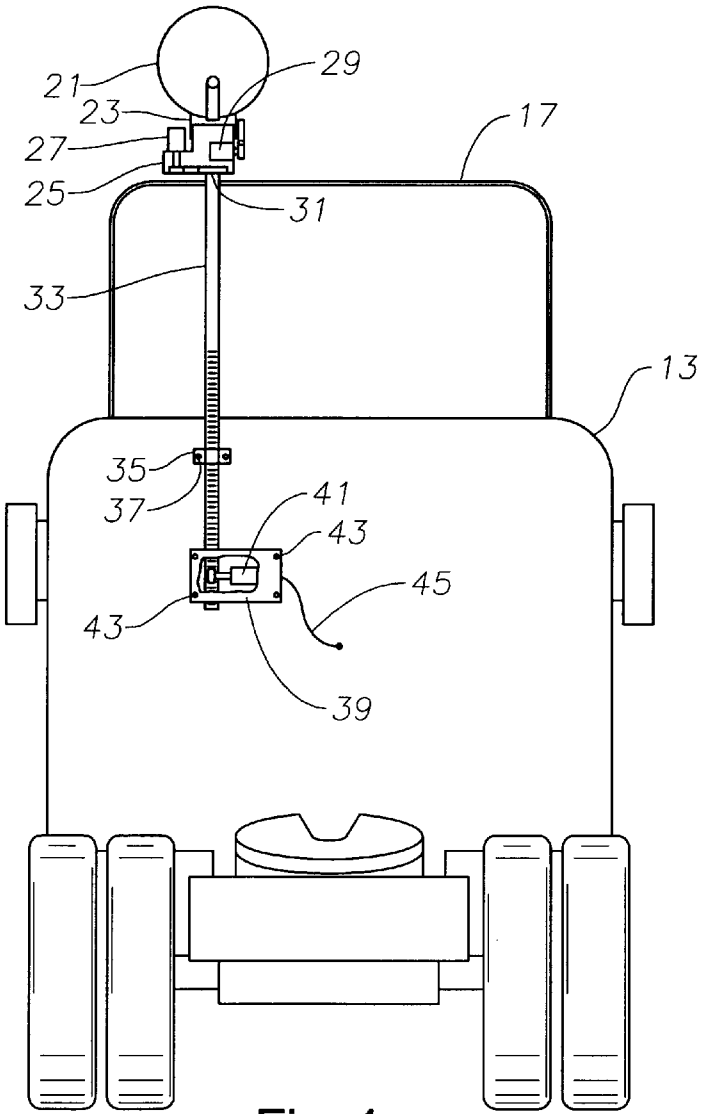
FIG. 4 is a perspective view of a tractor-trailer rig, which has the satellite dish assembly of FIG. 2, in its raised and stationary position.

First, the operator turns on and operates elevation motor 41 to raise telescoping mast 33. Motor 41 is connected to mast 33 so that as elevation motor 41 is operating, telescoping mast 33 is raised. Referring to FIGS. 2 and 4, after telescoping mast 33 is raised, dish 21 is above the top edge of wind foil 17 as well as being above the top of trailer 15 (FIG. 1). With dish 21 being higher than the top of wind foil 17 and trailer 15, no part of tractor-trailer 11 prevents dish 21 from receiving the satellite transmission.

With dish 21 in its raised position, operator can then use azimuth motor 27 and angular motor 29 to point dish 21 towards the transmitting satellite. With existing technology, an operator will enter into the controls located inside the passenger compartment the zip code of the area that vehicle 11 is located. The controls inside the passenger compartment tilt dish 21 so that dish 21 is pointed towards the transmitting satellite. Using the zip code of the area that vehicle 11 is located is discussed, but other methods of determining the angle to aim dish 21 are also plausible with this embodiment. For example, the operator could enter the zip code or the nearest city to where vehicle 11 is located before raising telescoping mast 33. The control system would then raise satellite dish assembly 19 on mast 33, and then rotate and tilt satellite dish 21. In another example, the operator may locate vehicle 11 using a global positioning satellite system and then aim dish 21 based upon that location.

Angular motor 29 is engaged to tilt dish 21 the appropriate angle towards the sky. The drive shaft from angular motor 29 connects to a direction disk 24 through rubber belt 30 at the base of support member 23 supporting dish 21. When angular motor 29 is operated, the drive shaft turns belt 30 and directional disk 24, which in turn tilts dish 21. Angular motor 29 tilts support member 23 and dish 21 all the way back, and then forward the number of degrees required by the zip code location, thereby changing the angle dish 21 faces towards the sky. Dish 21 is rotated up to 360 degrees to face the transmitting satellite by operating azimuth motor 27.

The drive member of azimuth motor 27 is connected to rotational disk 31 through pulley and rubber belt system 28. Rotational disk 31 turns about its vertical axis when motor 27 turns its drive member. Both motor assembly 25 and dish 21 also rotate when rotational disk 31 turns about its vertical axis. The operator disengages azimuth motor 27 when dish 21 is pointed to where dish 21 only needs to be tilted at an angle towards the sky for dish 21 to receive the satellite transmissions. With satellite dish 21 rotated and tilted so that dish is pointing towards the transmission satellite, the operator is able to receive satellite transmissions to watch television inside the passenger compartment of tractor 13.

Satellite dish assembly 19 needs to be returned to its lowered position before tractor trailer rig 11 departs for its next destination. The operator uses both azimuth motor 27 and angular motor 29 to angle dish 21 so that it can be lowered behind wind foil 17 without damaging dish 21. Angular motor 29 tilts support member 23 and dish 21 so that dish 21 is facing the horizon instead of the sky. Azimuth motor 27 rotates dish 21 so that dish 21 is facing directly away from the backside of tractor 13 and towards trailer 15. With dish 21 pointing this way, satellite dish 21 is capable of being lowered behind wind foil 17 to a point below its top edge without dish 21 making contact with wind foil 17. In the preferred embodiment, elevation motor 39 is engaged to lower mast 33, having satellite dish 21 above it, to a point where satellite dish 21 is below the top edge of wind foil 17. When dish 21 is behind wind foil 17, and below the top edge of wind foil 17, satellite dish assembly 19 is in the lowered or traveling position. In the preferred embodiment, the control system allows the operator to automatically retract dish assembly into its traveling position with one command, which can be pushing one button or control knob.

Figure 5:
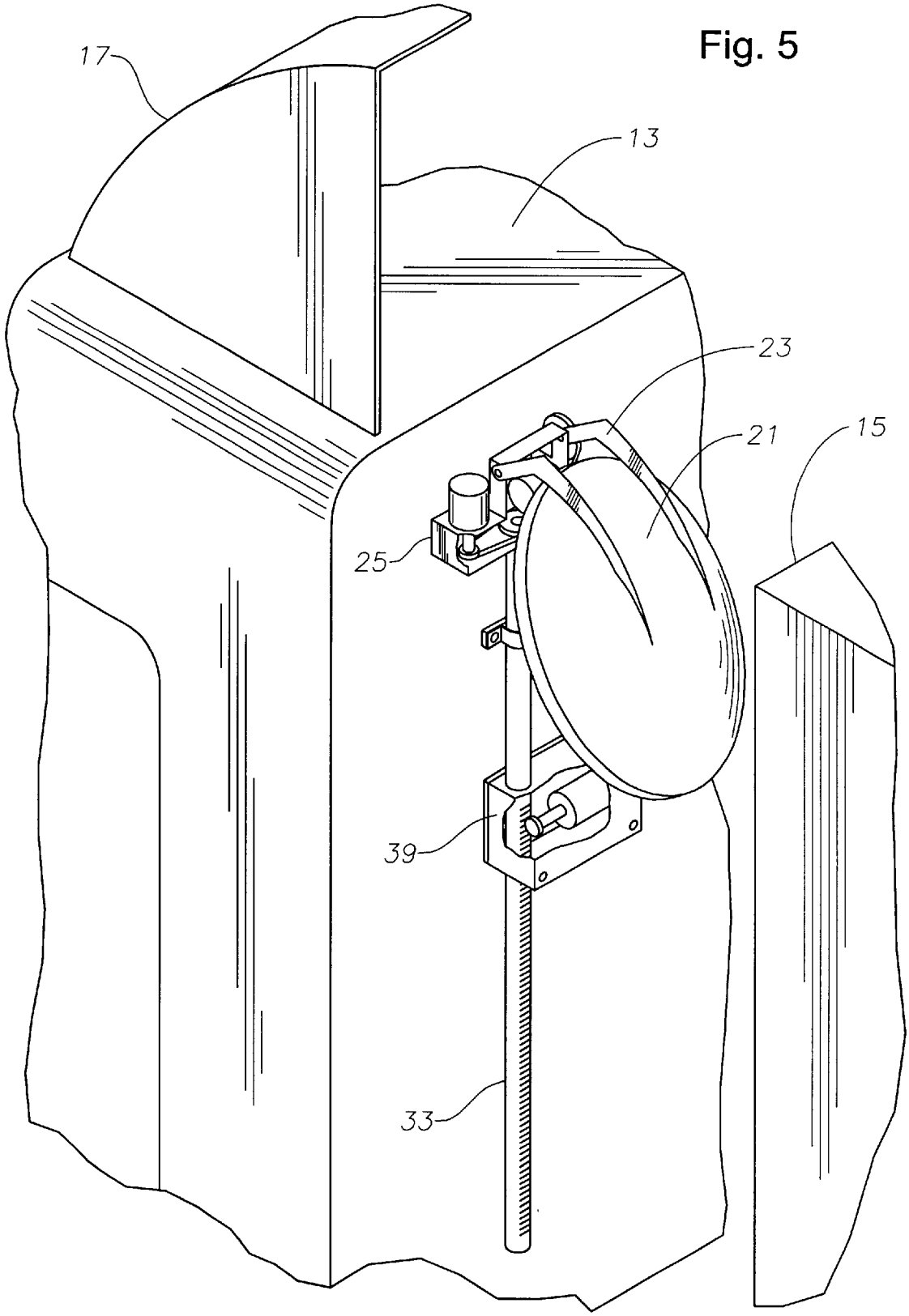
FIG. 5 is a perspective view of another embodiment of the satellite dish assembly in FIG. 2 in its lowered and traveling position.
Figure 8:
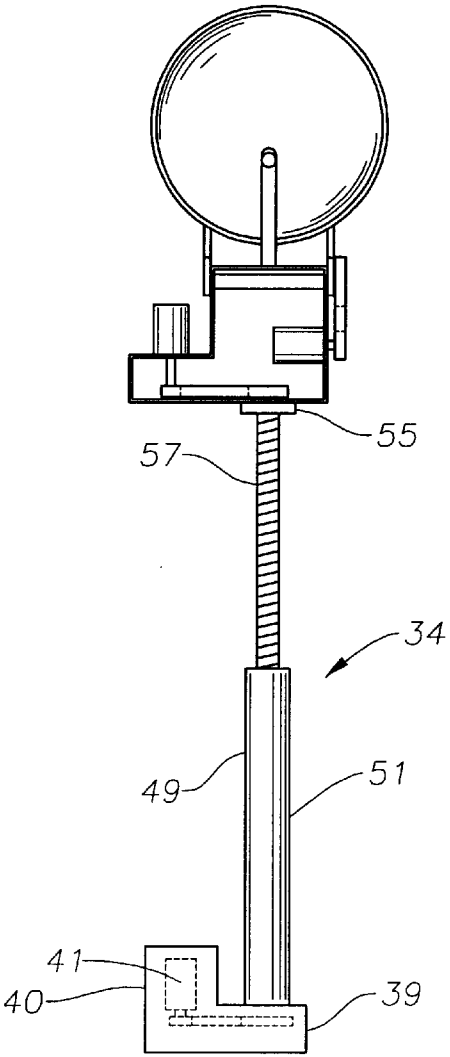
FIG. 8 is an elevational of the backside of the satellite dish assembly shown in FIG. 6.
Figure 7:
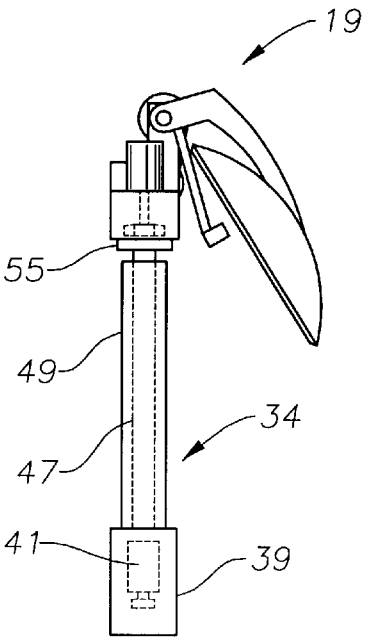
FIG. 7 is an elevational view the right side of the satellite dish assembly shown in FIG. 6 while in its lowered and traveling position.
Figure 6:
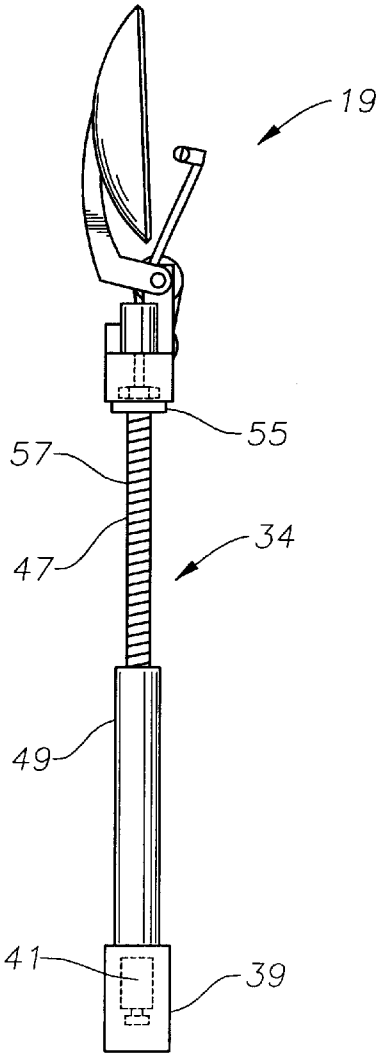
FIG. 6 is an elevational view of a right side of another embodiment of the satellite dish assembly in FIG. 2, in its raised and stationary position.

Referring to FIG. 5, in another embodiment, dish 21 is further folded over (or tilted even further) after dish 21 is facing away from the backside of tractor 13 towards the horizon. In this embodiment, angular motor 29 tilts support member 23 and dish 21 away from the back side of tractor 13, about 180 degrees, until dish 21 is facing the backside of tractor 13, in a lower position. In this embodiment, mast 33 does not have to be as tall because dish 21 does not have to be lowered as much to place 21 below wind foil 17 and behind tractor 13.

Another embodiment is shown in FIGS. 6–9, which shows a telescoping mast 34 having an upper portion 47 and a lower portion 49. In the preferred embodiment, upper portion 47 has a smaller diameter than the inner diameter of lower portion 49 allowing upper portion 47 to retract into lower portion 49. Satellite assembly 19 is mounted to telescoping mast 34 on a bearing 55 located on top of upper portion 47. Bearing 55 allows satellite assembly to remain stationary relative to mast 34 as upper portion 47 is elevated.

Motor box 39 has an additional upper section 40 (shown in FIG. 8) extending upwards alongside of mast 33. In this embodiment, motor 41 is parallel to mast 33 and is located in upper portion 40 of box 39. The drive member of elevation motor 41 raises or extends upper portion 47 out of lower portion 49. The drive member of motor 41 drives a screw jack 51 in order to raise and lower dish assembly 19 mounted on the upper portion 47 of mast 33. In a manner known in the art, screw jack 51 engages threads 57 on upper portion 47 with a rotating nut (not shown) to cause upper portion 47 to retract and extend.

Figure 9:
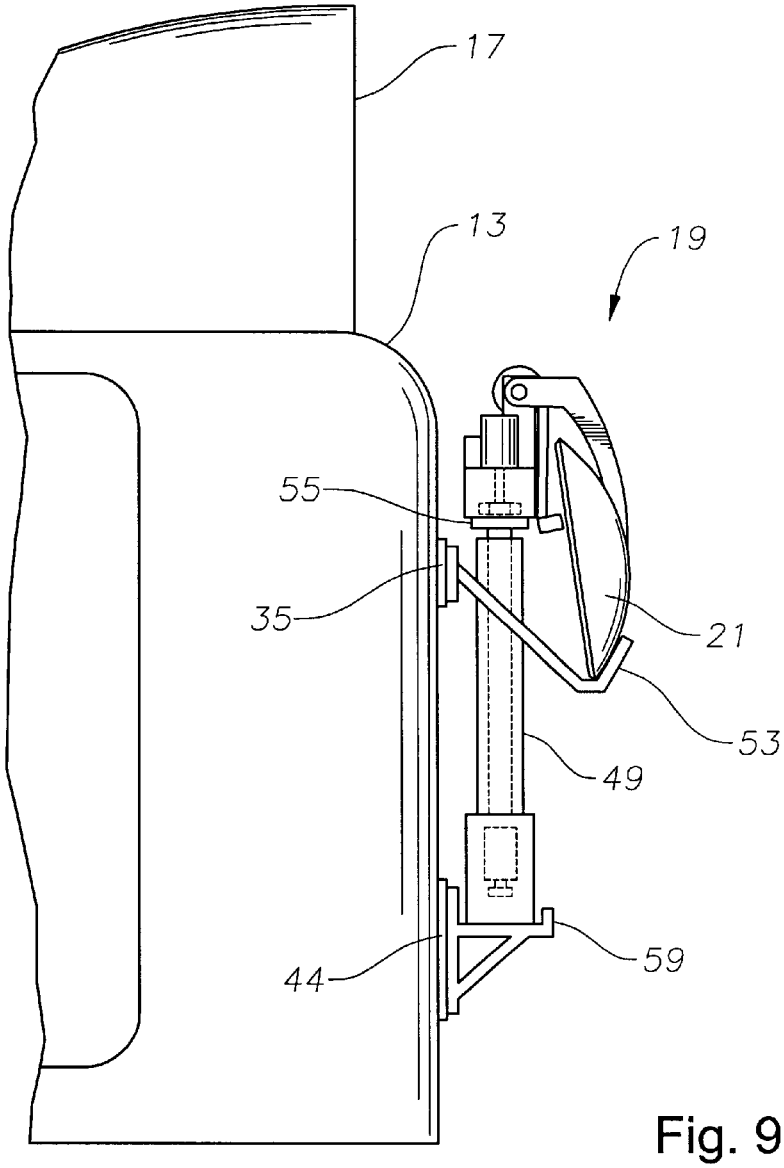
FIG. 9 is a perspective view of another embodiment of the satellite dish assembly shown in FIG. 6.

Referring to FIG. 9, a dish support bracket 53 can also be used to support dish 21 when dish 21 is folded over as described above. Support bracket 53 extends away from the backside of tractor 13 and engages the lower portion and backside of dish 21 when dish assembly 19 is in its lowered, traveling position. Support bracket 53 helps to prevent dish 21 from bouncing and vibrating during travel. The support provided by bracket 53 may help to protect dish 21 from damage. Bracket 53 may also help protect the connection of support member 23 and motor assembly 25 from damage.

FIG. 9 also shows a support bracket 59 located below elevation motor box 39. Bracket 59 attaches to the backside of tractor 13 and supports most of the weight of dish assembly 19. Typically a gasket 44 is placed between bracket 59 and tractor 13 to absorb some of the vibrations from tractor 13 while traveling. Bracket 59 could also be adapted for use with the embodiments shown in FIGS. 2–5.

Further, it will also be apparent to those skilled in the art that modifications, changes and substitutions may be made to the preferred embodiment in the foregoing disclosure. Accordingly, it is appropriate that this should be construed broadly and in he manner consisting with the spirit and scope of the preferred embodiment herein.

What is claimed is:

1. An assembly for mounting to a vehicle to receive satellite transmissions, comprising:

a telescoping mast;

an elevation motor that is adapted to be attached to a vehicle and engages the mast for extending and retracting the mast;

a receiver of satellite transmissions mounted on the upper portion of the telescoping mast;

an azimuth motor below the receiver that rotates the receiver along the horizon for aligning the receiver in a desired direction; and an angular motor below the receiver that tilts the receiver to a desired angle wherein the receiver is pointed at a transmitting satellite.

2. The assembly of claim 1, wherein the receiver is a parabolic satellite dish having a face and a backside.

3. The assembly of claim 1, wherein the elevation motor extends and retracts the mast by linearly moving the mast along an axis of the mast.

4. The assembly of claim 1, wherein the azimuth motor is located between the mast and the receiver; and further comprises:

a rotatable disk between the receiver and the mast that is connected to the drive shaft of the azimuth motor by a flexible drive linkage.

5. The assembly of claim 1, further comprising:

a angular disk fixedly connected to a support member extending down from a backside of the receiver for tilting movement with the receiver; and a flexible linkage extending between the angular motor and the angular disk.

6. The assembly of claim 1, wherein the angular motor rotates the receiver to a folded-over inverted position relative to the mast while in a traveling position.

7. The assembly of claim 1, wherein the elevation motor has a pinion gear that engages teeth formed on the mast.

8. The assembly of claim 1, wherein the mast comprises at least one upper portion that slidingly receives a lower portion and moves between retracted and extended positions, and wherein the upper portion has threads formed on its surface; and further comprises:

a screw jack in engagement with the threads on the upper portion of the mast; and the elevation motor rotates the screw jack to cause the screw jack to move the upper portion of the mast between the retracted and extended positions.

9. A vehicle, comprising:

a tractor of a tractor trailer rig, having a cab with a rearward wall;

a telescoping mast mounted vertically on the rearward wall of the tractor;

a satellite dish mounted to the mast;

a elevation motor located on the lower portion of the mast for raising the mast to position the satellite dish above an uppermost surface of the tractor, and for lowering the mast to position the satellite dish below the uppermost surface of the tractor.

10. The vehicle of claim 9, further comprises a support member located on the rearwall of the cab, the mast extending through the support member, which supports and stabilizes the upper portion of the mast.

11. The vehicle of claim 9, further comprising an angular motor located below the satellite dish that selectively tilts the satellite dish.

12. The vehicle of claim 9, further comprising an azimuth motor located below the satellite dish that selectively rotates the satellite dish in desired directions.

13. The vehicle of claim 9, wherein the elevation motor extends and retracts the mast by vertically moving the mast along an axis of the mast.

14. The vehicle of claim 9, wherein an angular motor located below the satellite dish rotates the receiver to a folded-over inverted position relative to the mast while in a traveling position.

15. The vehicle of claim 9, wherein the elevation motor has a pinion gear that engages teeth formed on the mast.

16. The vehicle of claim 9, wherein the mast comprises at least one upper portion that slidingly receives a lower portion and moves between retracted and extended positions, and wherein the upper portion has threads formed on its surface; and further comprises:

a screw jack in engagement with the threads on the upper portion of the mast; and the elevation motor rotates the screw jack to cause the screw jack to move the upper portion of the mast between the retracted and extended positions.

17. A method for receiving a satellite transmission in a tractor-trailer assembly, comprising:

(a) providing a satellite dish assembly having a satellite dish and an extensible mast, and mounting the dish assembly to a vertical rear wall of a tractor;

(b) while not in use, retracting the mast so that the satellite dish is at a lower elevation than an uppermost part of the tractor; and (c) while the tractor is not moving, extending the mast so that the satellite dish is at a higher elevation than the uppermost part of the tractor and orienting the satellite dish to receive a satellite transmission.

18. The method of claim 17, wherein orienting the satellite dish comprises:

(d) rotating and tilting the satellite dish to aim the satellite towards a satellite orbiting above the earth.

19. The method of claim 18, wherein steps (c) and (d) are performed with controls located inside the tractor.

20. The method of claim 17, wherein step (b) comprises lowering the satellite dish below a wind foil located on the roof of the tractor.

* * * * *